United States Patent [19]

Fairchild

[11] Patent Number: 4,505,836

[45] **Date of Patent: * Mar. 19, 1985**

[54] PLASTIC BOTTLE CLEANER COMPOSITION AND METHOD

[75] Inventor: Meredith H. Fairchild, Whittier, Calif.

[73] Assignee: TP Industrial, Inc., Lakewood, Calif.

[ * ] Notice: The portion of the term of this patent subsequent to Feb. 28, 2001 has been disclaimed.

[21] Appl. No.: 526,019

[22] Filed: Aug. 22, 1983

Related U.S. Application Data

[63] Continuation-in-part of Ser. No. 402,778, Jul. 28, 1982, Pat. No. 4,434,069.

[51] Int. Cl.[3] ..... C11D 1/78; C11D 3/10; C11D 7/12

[52] U.S. Cl. ..... 252/174.14; 252/156; 252/157; 252/174.16; 252/174.21; 252/DIG. 1; 252/DIG. 10; 252/DIG. 14; 252/DIG. 17; 134/22.17; 134/25.1; 134/25.4; 134/29; 134/30

[58] Field of Search ..... 252/174.14, 156, 157, 252/DIG. 1, DIG. 10, DIG. 14, 174.21, 174.16, DIG. 17; 134/29, 30, 22.17, 25.1, 25.4,

[56] References Cited

U.S. PATENT DOCUMENTS

| | | | |
|---|---|---|---|
| 2,976,248 | 3/1961 | Otrhalek . | |
| 3,010,907 | 11/1961 | Carroll | 252/174.16 |
| 3,463,737 | 8/1969 | Kasperl et al. . | |
| 3,672,993 | 6/1972 | Mitchell et al. . | |
| 3,755,509 | 8/1973 | Nunn, Jr. et al. | 252/174.16 |
| 3,770,855 | 11/1973 | Benson | 252/174.16 |
| 3,869,412 | 3/1975 | Waag | 252/174.16 |
| 3,944,500 | 3/1976 | Gancy et al. . | |
| 3,971,726 | 7/1976 | Smith et al. . | |
| 3,996,149 | 12/1976 | Burke, Jr. . | |
| 4,049,586 | 9/1977 | Collier . | |
| 4,081,395 | 3/1978 | Talley | 252/531 |
| 4,196,093 | 4/1980 | Clarke et al. . | |
| 4,210,550 | 7/1980 | Cornelissens . | |
| 4,212,761 | 7/1980 | Ciaccio . | |
| 4,294,718 | 10/1981 | Kaeser . | |
| 4,298,493 | 11/1981 | Schreiber . | |
| 4,299,716 | 11/1981 | Cottrell et al. . | |
| 4,434,069 | 2/1984 | Fairchild | 252/174.14 |

OTHER PUBLICATIONS

Technical Bulletin, 7543-096, General Aniline and Film Corporation.

*Primary Examiner*—John E. Kittle
*Assistant Examiner*—Mukund J. Shah
*Attorney, Agent, or Firm*—William W. Haefliger

[57] ABSTRACT

A process of cleaning a polycarbonate surface or bottle includes (a) washing the surface or bottle with a composition consisting essentially of an aqueous basic solution containing the members: alkali metal carbonate, alkali metal bi-carbonate and a mixture of mono and di esters of phosphoric acid, and (b) then rinsing the surface or bottle with water.

14 Claims, 1 Drawing Figure

A - 50 ml OF 0.35% SODIUM HYDROXIDE

B - 50 ml OF 1.25% NOVEL CLEANER OF PRESENT INVENTION

PLASTIC BOTTLE CLEANER COMPOSITION AND METHOD

BACKGROUND OF THE INVENTION

This application is a continuation-in-part of my prior application Ser. No. 402,778 filed July 28, 1982, now U.S. Pat. No. 4,434,069.

This invention relates generally to cleaning of poly carbonate surfaces such as those of drinking water bottles, and more particularly concerns cleaning compositions of this type that are free of chlorine and will not cause stress cracking or crazing of such containers.

The problems of chlorine fume production, and stress cracking and crazing of polycarbonate surfaces as in containers arise during washing or cleaning of same, using conventional cleaning compositions. Such containers are commonly used for drinking water, they are considered reusable, and therefore must be washed or cleaned. Public health regulations require an alkalinity titration equivalent to 0.35% as sodium hydroxide; however, a pH higher than 11.0 can be detrimental and cause the described crazing and stress cracking. Also, since the bottles are used for drinking water, the cleaning compositions must be non-toxic and leave no objectionable odor or taste.

In addition, it has been discovered that after polycarbonate type plastic such as LEXON T.M. and MERCON T.M. have been exposed to ozone treated water and subsequently exposed to certain cleaning compositions, they acquire a hazy film that cannot be removed or rubbed off. No way was known to avoid such problems, using conventional cleaning compositions.

SUMMARY OF THE INVENTION

It is a major object of the invention to provide a cleaning composition, and process, that avoids the above problems.

In its composition aspects, the invention concerns the provision of alkali metal salts so combined that they have, at use concentrations, a pH of 11.0 or less and an adequate reserve of titratable alkalinity, at least equivalent to 0.35 percent caustic soda (sodium hydroxide), when titrated to the colorless phenolphthalein end point, which is about pH 8.0. In addition, when the composition contains a small amount of a mixture of mono and di esters of phosphoric acid, the composition does not crack or craze polycarbonate containers, nor does it leave a residual film even when the polycarbonate has been exposed to ozone treated water.

In its process aspects, the invention involves the steps:

(a) washing the poly carbonate bottle with a composition consisting of a basic solution containing an alkali metal carbonate, an alkali metal bi-carbonate and a mixture of mono and di ester of phosphoric acid, and (b) rinsing the bottle with water.

As will appear, the solution pH is adjusted below 11.0 by adjustment of ingredient weight percentages.

DETAILED DESCRIPTION

Figure 1:
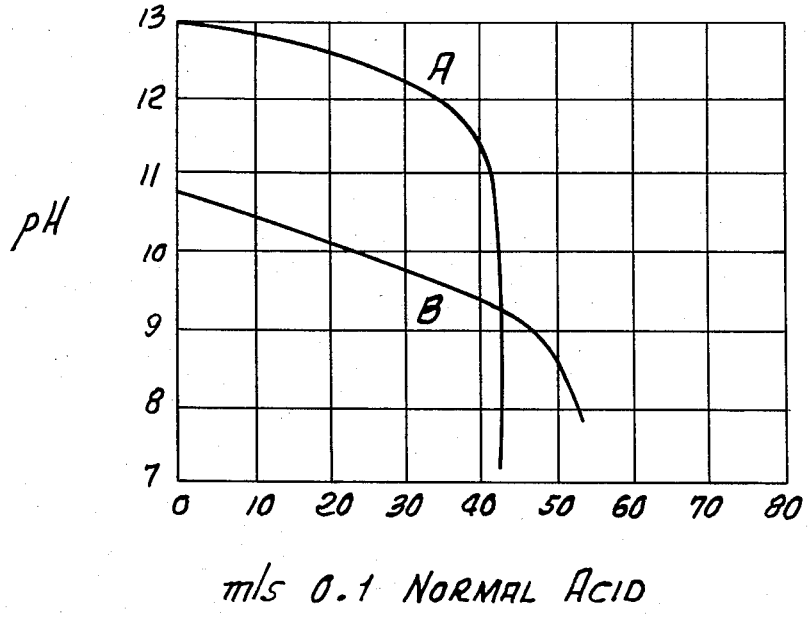

The aqueous washes or solutions of the present invention are based on use of mixtures of sodium carbonate, sodium bi-carbonate and a small percentage of low foaming surfactant. Of especial benefit is a surfactant composition that consists of a mixture of mono and di esters of phosphoric acid. As will appear, a cleaning composition or concentrate is prepared or supplied, for example, and added to or combined with a much larger (relative) volume of water. For example, between 1.6 and 2.0 ounces of concentrate is added to or combined with a gallon of water, these being relative proportions.

One basic concentrate formula is:

| Ingredient | Range (weight %) Broad | Preferred |
|---|---|---|
| sodium carbonate | 84–90% | 88% |
| sodium bi-carbonate | 10–12% | 11% |
| low-foaming surfactant, or EMPHOS TM PS-410 (Witco Chemical) | .5–1.5% | 1% |

A second concentrate formula, by way of example is:

| Ingredient | Range (weight %) Broad | Preferred |
|---|---|---|
| potassium carbonate | 86–90% | 89% |
| potassium bi-carbonate | 9–11% | 10% |
| low-foaming surfactant, or EMPHOS TM PS-410 | .5–1.5% | 1% |

A third concentrate formula, by way of example is:

| Ingredient | Range (weight %) Broad | Preferred |
|---|---|---|
| lithium carbonate | 87–91% | 90.7% |
| sodium bi-carbonate | 8–10% | 8.3% |
| low-foaming surfactant, or Emphos TM PS-410 | .5–1.5% | 1.0% |

The especially beneficial EMPOS PS 410 is a mixture of mono and di esters of phosphoric acid, selected from the formula groups (A) and (B), as follows:

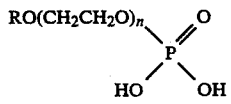

(A)

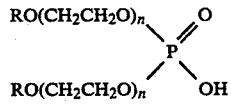

(B)

where:

R is an ethoxylated linear alcohol, n is an integer between 1 and 10, chosen for water solubility and low foaming.

The amount of (A) relative to (B) is nominally 50—50 but can range from 40% A and 60% B to 40% B and 60% A, on a weight percent basis.

The above concentrate, which is a free flowing, granular, alkaline powder, mixed with a relatively large volume of water, as referred to, provides a poly carbonate surface wash solution having a pH below 11.0 and preferably about 10.5. The sodium carbonates and bi-carbonates are readily available and low priced; however, the alkali metal carbonates and bi-carbonates or mixtures of same may be used (potassium and lithium for example).

EXAMPLE

The above solution is sprayed onto poly carbonate bottle surfaces, as by means of a spray washer having a spray nozzle, at a temperature or temperatures between 120° F. and 150° F., and preferably about 130° F. The spray wash is continued for 1.5 to 3 minutes. Thereafter, the bottle is rinsed with distilled water, or soft water, for at least about 30 seconds.

A graph of the pH requirements and the alkalinity requirements is given by a plot of the variation of the pH as the alkalinity is reduced by titration with a standard acid. See FIG. 1. Curve A, sodium hydroxide, has a pH much above 11 until nearby all of its alkalinity is used up. Curve B, the basic concentration formula of the present invention, starts out with a pH below 11.0, which slowly drops as the alkalinity is used up and does not drop below the effective alkali range at pH 8.0 until after more acid is consumed than is used by sodium hydroxide.

The materials of choice are sodium carbonate and sodium bi-carbonate; however, other alkali metals such as potassium and lithium give similar acceptable curves.

The above composition and process provide the following benefits:

1. Preparation of the wash solution is readily carried out by mixing of concentrate with cold water.
2. The wash solution is non-foaming at the described concentrations and temperatures.
3. The solution is free of chlorine and thus free of such fumes.
4. The solution removes most paper labels from containers.
5. The solution does not leave odor or after-taste in container, particularly after rinsing.
6. The containers do not become crazed or cracked as a result of washing as described.
7. When EMPHOS PS 410 is employed, there is no residual film on the polycarbonate plastic surface even when that surface has been previously exposed to ozone treated water.

I claim:

1. The process of cleaning a polycarbonate surface that includes
- (a) washing the surface with a composition consisting essentially of an aqueous basic solution containing the members: alkali metal carbonate, alkali metal bi-carbonate and a mixture of mono and di esters of phosphoric acid, .
- (b) then rinsing the surface with water, and
- (c) said members being in the relative weight percent proportions:
  - (i) between 84 and 91% alkali metal carbonate
  - (ii) between 8 and 12% alkali metal bi-carbonate
  - (iii) between 0.5 and 1.5% of said mixture of mono and di esters of phosphoric acid.

2. The process of claim 1 wherein the solution pH is at or below 11.0.

3. The process of claim 1 wherein the solution pH is about 10.5.

4. The process of cleaning a polycarbonate surface that includes
- (a) washing the surface with a composition consisting essentially of an aqueous basic solution containing the members: alkali metal carbonate, alkali metal bi-carbonate and a mixture of mono and di esters of phosphoric acid,
- (b) then rinsing the surface with water,
- (c) and said members being in the relative weight % proportions:
  - about 88% sodium carbonate
  - about 11% sodium bi-carbonate
  - about 1% of said mixture of mono and di esters of phosphoric acid.

5. The process of claim 4 wherein the balance of the solution consists of water.

6. The process of one of claims 1–4 wherein the solution consists of a relatively small volume of concentrate containing said members added to a relatively large volume of water.

7. The process of claim 6 wherein said small and large volumes are in the relative proportions 1.6 to 2 ounces of concentrate per gallon of water.

8. The process of claim 1 wherein said washing comprises spraying the surface with said solution.

9. The process of claim 8 wherein said spraying is continued for a time interval between 1.5 and 3.0 minutes.

10. The process of one of claims 1 and 8 which the temperature of the solution is between 120° F. and 150° F.

11. The process of claim 1 wherein said alkali metal carbonate is selected from the group consisting of sodium carbonate, potassium carbonate and lithium carbonate, and said alkali metal bi-carbonate is selected from the group consisting of sodium bi-carbonate, potassium bi-carbonate and lithium bi-carbonate.

12. The process of one of claims 1–5, 7–9 and 11, wherein the surface is defined by a container.

13. The process of one of claims 1–5, 7–9 and 11, wherein the surface has been previously exposed to ozone treated water.

14. The process of one of claims 1–5, 7–9 and 11, wherein said mono and di esters are selected from the formula group (A) and (B), as folows:

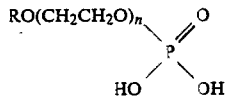

A)

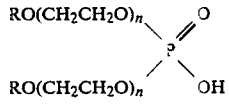

B)

where:

R is an ethoxylated linear alcohol, n is an integer between 1 and 10, chosen for water solubility and low foaming.

* * * * *